US007568324B2

(12) United States Patent
Bussey, III et al.

(10) Patent No.: US 7,568,324 B2
(45) Date of Patent: Aug. 4, 2009

(54) CUSHIONED PACKAGE AND METHOD OF MAKING

(76) Inventors: Buddy Harry Bussey, III, 4 Windy Hill, Atlantic Highlands, NJ (US) 07716; Harry Bussey, Jr., 960 Cape Marco Dr., Unit 1803, Marco Island, FL (US) 33937

( * ) Notice: Subject to any disclaimer, the term of this patent is extended or adjusted under 35 U.S.C. 154(b) by 504 days.

(21) Appl. No.: 10/996,531

(22) Filed: Nov. 24, 2004

(65) Prior Publication Data

US 2006/0108256 A1 May 25, 2006

(51) Int. Cl.
*B65B 31/06* (2006.01)
*B65B 31/08* (2006.01)
*B65B 61/00* (2006.01)

(52) U.S. Cl. ..... 53/86; 53/129.1; 206/522

(58) Field of Classification Search ..... 53/86, 53/129.1; 206/521, 522, 591, 594
See application file for complete search history.

(56) References Cited

U.S. PATENT DOCUMENTS 5,402,892 A * 4/1995 Jaszai ..... 206/522
5,588,532 A * 12/1996 Pharo ..... 206/522
5,624,035 A * 4/1997 Kim ..... 206/522
5,873,217 A * 2/1999 Smith ..... 53/434
6,520,333 B1 * 2/2003 Tschantz ..... 206/522

FOREIGN PATENT DOCUMENTS

DE 4319682 * 1/1994 ..... 53/86

* cited by examiner

*Primary Examiner*—Rinaldi I. Rada
*Assistant Examiner*—John Paradiso
(74) *Attorney, Agent, or Firm*—Francis C. Hand; Carella, Byrne, Bain et al.

(57) ABSTRACT

The package is made of cardboard with one or more plastic envelopes laminated to at least the side walls of the package. The envelopes are inflated from without the carton via a hollow needle that passes through a side wall of the package and a glue spot adhering the envelope in place. Air, nitrogen, foamable material or polystyrene beads may pass through the hollow needle to inflate the envelope(s).

11 Claims, 4 Drawing Sheets

CUSHIONED PACKAGE AND METHOD OF MAKING

This invention relates to a cushioned package and to a method of making a cushioned package.

As is known, several techniques have been employed for packaging goods, particularly fragile goods, in cartons, envelopes and the like. In some cases, use has been made of loose fill elements which can be poured into a carton about and around an object to be protected against damage during transport. In other cases, a foamable material is blown into a carton in order to foam about and around the object to be packaged. In still other cases, use has been made of small packets or bags of air have been positioned around the object to be packaged. Use has also been made of the so-called bubble wrap that can be wrapped about an object being packaged. Envelopes have also been lined with bubble wrap to provide cushioning for an object to be placed in the envelope.

Each of these techniques present limitations. In the case of loose fill elements, foamed materials and loose bags of air, the user needs to use labor to properly place the cushioning items around and about the object being packaged in a carton. There is also the issue of obtaining a proper fit of the object within the carton using loose fill elements and air bags. While the use of a foamable material avoids these problems, the use of a foamable material is time-consuming and cumbersome. Further, the ultimate consumer is faced with the task of disposing of the loose fill elements or the foamed materials or bags separately from the carton containing these materials.

The use of bubble wrap sheets requires the user not only to wrap the object to be packaged before being deposited in a carton but also to add more bubble wrap or loose fill elements to secure the object in place. There is also a need to have the bubble wrap disposed of separately from the carton after use.

Using an envelope laminated with bubble wrap limits the capacity of the envelope to receive an object in a tightly fitted cushioned manner.

In order to avoid some of the problems associated with the above techniques of packaging, use has been made of inflatable bags and liners, such as described in U.S. Pat. Nos. 3,889,743; 4,145,973; 6,755,568 and published U.S. patent application Ser. No. 2003/0062286. Generally, these inflatable bags are to be disposed in a carton between an article being packaged and a wall of the carton. Typically, the bags have been provided with an inflation tube for filling of the bags with air prior to closing the carton.

Other techniques have used inflatable bags that can be inflated after a carton has been closed via a spout that extends out of the carton, such as described in U.S. Pat. Nos. 4,793,123; and 5,254,074. However, these techniques require an accurate positioning of the spouts in order to allow access to the spouts when an inflation step is to be performed. In some cases, the bags are to be inflated via a valve that is fixedly mounted in an opening in the wall of the carton, such as described in U.S. Pat. Nos. 5,901,850; 6,250,467; and 6,253,919 and published U.S. patent application Ser. Nos. 2001/0001921 and 2003/0006162. However, in these cases, there is a risk that the valves will not be properly mounted in place so that the bags cannot be inflated as well as a risk that the valves may leak after a bag has been inflated thereby allowing the bags to deflate when in transit. Further, there is an added expense in providing a bag with a valve and ensuring that the bag is not damaged during affixing of the valve in place as well as an added expense in providing a hole in a carton and positioning a valve in the hole.

Accordingly, it is an object of the invention to simplify packaging procedures for shipping objects in a protected manner.

It is another object of the invention to provide a carton with cushioning that can be readily disposed of by a consumer.

It is another object of the invention to inflate an inflatable cushion within a carton after closure in a simple reliable manner.

It is another object of the invention to retain an inflated cushion within a sealed carton in an inflated state during transit.

It is another object of the invention to provide an inexpensive arrangement of a carton with a bag that can be inflated from outside after sealing of the carton.

It is another object of the invention to be able to firmly secure one or more objects in a carton for shipping purposes.

Briefly, the invention provides a package that has at least one wall that defines a closed compartment for receiving goods and an inflatable cushion defining an enclosed space within and disposed on the wall. Typically, the cushion is made of plastic in the form of an envelope and is secured to the inside of the wall by a glue spot, for example, of a sealable flexible glue.

The package may also have an indicia, such as a printed bulls-eye, on an outside of the wall that is indicative of and is in alignment with the glue spot.

The wall of the package may be cardboard, for example where the package is in the shape of a box or carton or tube, or of heavy paper or envelope paper where the package is of envelope type. The wall of the package may also be of other suitable materials, such as plastic, metal foil, and any material that may be used for packaging.

In accordance with the invention, after an object has been placed within the package and the package closed, the inflatable cushion within the package is inflated from outside the package. Inflation of the cushion is performed by using a hollow needle to penetrate through the package wall and the glue spot and to pass into the interior of the cushion. In addition, a stream of fluid is blown through the needle into the cushion for inflation of the cushion. Upon inflation, the cushion expands within the closed compartment of the package to hold the object within the package in a tight fit and secure manner. After inflation, the needle is removed and the glue of the glue spot seals over the passage made in the glue spot to trap the fluid within the inflated cushion.

The needle may be used to blow several different types of materials into the cushion within the carton. For example, the needle may be used to blow a gas, a foamable material, a stream of expandable polystyrene beads or any other suitable material into the cushion. The gas may be air or, in the case where flammable materials are to be avoided, the gas may be nitrogen or any other suitable non-flammable gas. Also, the material may be a fire-retardant fluid.

In an embodiment in which a foamable material is injected into the cushion, the cushion may be provided with vents, such as, pin holes, in order to allow for the escape of air from within the cushion during foaming of the foamable material. The same type of cushion can be used where the needle injects a flow of polystyrene beads into the cushions.

In another embodiment, use may be made of a second glue spot within the envelope that is covered by a protective tape to prevent the glue spot from adhering the two plies of the envelope together. In this embodiment, the second glue spot is aligned with the glue spot that secures the envelope to the carton wall. As above, the needle is used to pierce through both glue spots while air or other fluid or material is injected into the envelope to inflate the envelope. Upon withdrawal of the needle, the two glue spots ensure that the opening made in the envelope by the needle is sealed over. In this embodiment, the glue spot within the envelope can be provided with a release paper which can also be used as a flat seal or check valve.

The package may be made from a cardboard blank that can be folded into a prismatic or cubic shape to form a box or carton with parallel side walls. In this case, an inflatable cushion may be provided on each of the walls of the carton as well as on a bottom wall or one cushion may be used to cover two of the side walls while another cushion covers two of the other side walls or one cushion may cover all of the side walls. A cushion may also be mounted on one of the side walls in a manner so that a lower portion of the cushion lies over the bottom wall of the carton.

In another embodiment, the package may be made from a cardboard blank that has a central portion for folding over to form four walls of a carton, and a plurality of flaps that extend from each side of the central portion for folding into an inter-engageable manner to from a bottom of the carton and a top of the carton. In this embodiment, the inflatable cushion is secured in overlying relation to the central portion and partially over each set of flaps whereby upon folding of the central portion and the flaps, the cushion lines the four vertical walls, at least a part of the bottom and at least a part of the top of the carton.

During use, once an object has been placed in a carton constructed in accordance with the invention, the carton is closed and sealed, for example in a taping machine. Thereafter, the carton is placed in an inflation station wherein the needle is passed through the wall of the carton and the glue spot into the interior of the cushion in order to inflate the cushion. In this respect, the plastic cushion within the carton is typically secured to four walls of the carton so that the cushion may be inflated about the four walls of the carton. Alternatively, two needles may be used on opposite sides of the carton to inflate cushions that are secured to only two walls each of the carton. Also, the closed carton may be manipulated so that a set of four needles is used simultaneously to fill the cushion, one needle for each vertical wall, or one needle is used to sequentially pass through the four walls to inflate the cushion.

Positioning of the carton in the inflation station is such that the glue spot of the carton is aligned with the path of the needle. To this end, the outside of the carton may be provided with a bull's-eye or other indicia to indicate the location of the glue spot within the carton and the point at which the needle is to pass through the carton.

After the cushions within the carton have been inflated, the needle is removed and the opening caused by the needle in the plastic cushion is sealed over by the glue spot(s) and the passage in the glue spot(s) itself is closed over in a self-sealing manner. In this respect, the term "glue spot" means any material that is capable of securing the cushion to the inside of the paper layer and of self-sealing upon removal of the needle.

In other embodiments, the needle may be heated in order to re-melt the glue spot during withdrawal of the needle through the glue spot. Several techniques may be used to provide the heat required for the resealing of the glue spot. For example, rather than heating the needle directly, use may be made of a stylus reciprocally mounted within the needle for heating of the glue spot during withdrawal of the needle from the carton and over the stylus.

The needle may also be provided with a roughened surface or grooves or ridges to facilitate the pulling of the glue back into the hole made by the needle upon piercing the glue spot(s).

The invention further provides a method of making a package wherein an inflatable cushion defining an enclosed space within the package may be inflated from outside the package. In this respect, the method includes the steps of penetrating a wall of the carton with a hollow needle and passing a stream of fluid through the hollow needle into the cushion in order to inflate the cushion and thereby secure an object within the package.

The method may be performed manually or automatically.

These and other objects and advantages of the invention will become more apparent from the following detailed description taken in conjunction with the accompanying drawings wherein.

Figure 1:
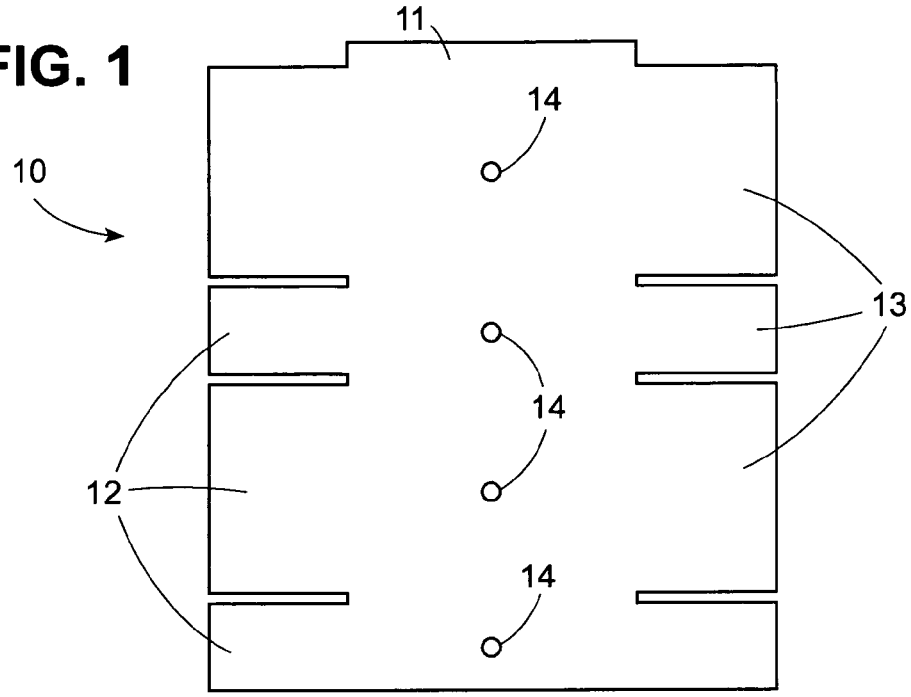
FIG. 1 illustrates a cardboard blank constructed in accordance with the invention.

Referring to FIG. 1, the cardboard blank 10 is of conventional construction and is die cut in order to form a carton of prismatic or cubic shape. In this embodiment, the blank 10 has a central portion 11 that is foldable over on itself to form four solid vertical walls of a carton while being secured at the two ends. The blank 10 also has a plurality of flaps 12 that extend from one side of the central portion 11 and that are inter-engageable to define a bottom of the carton and a similar plurality of flaps 13 that extend from an opposite side of the central portion 11 and that are inter-engageable to define a top of the carton.

The cardboard blank 10 is also provided with at least one glue spot 14, and in the embodiment shown, the blank 10 has a plurality of spaced apart glue spots 14, for example of a hot melt pressure sensitive glue or any suitable glue that will self-seal for the purposes described below.

Figure 2:
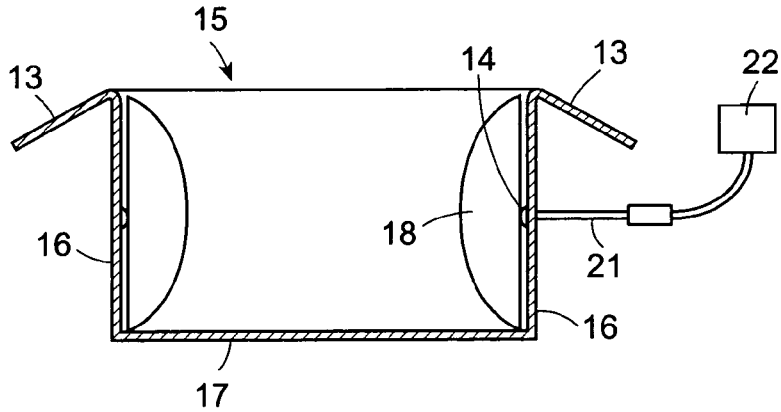
FIG. 2 illustrates a partial side view of a carton formed by the blank of FIG. 1 in accordance with the invention.
Figure 3:
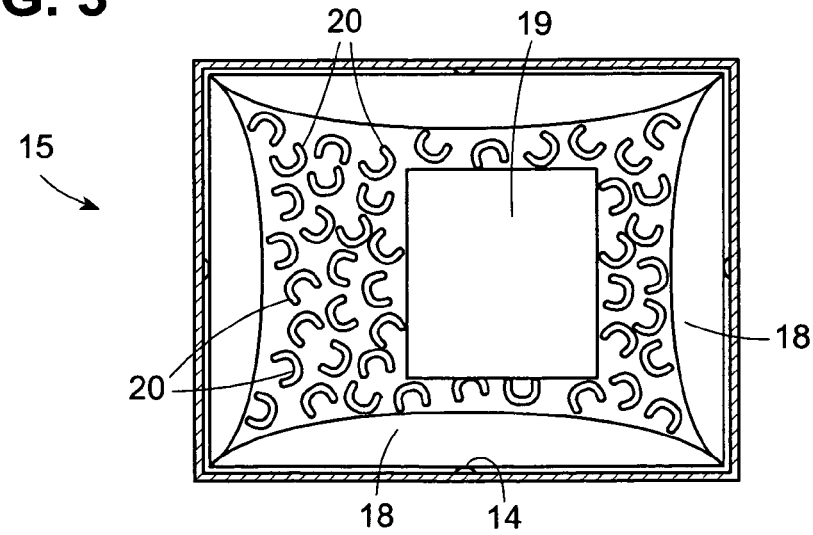
FIG. 3 illustrates a top view of the carton of FIG. 2 with an object in place.

Referring to FIGS. 2 and 3, when folded, the blank 10 forms a carton 15 of prismatic box-like shape with four vertical side walls 16, a closed bottom 17 and flaps 13 to form a closed top.

The blank 10 is also provided with an inflatable cushion in the form of a plastic envelope 18 of two-ply construction that defines an enclosed space. This envelope 18 is laid across the glue spots 14 on the blank 10 to be secured to the blank 10. When the blank 10 is folded into a carton 15, the envelope 18 lies along the four vertical walls 16 of the carton as indicated in FIG. 2. Alternatively, two envelopes (not shown) may be secured longitudinally over the central portion 11 of the blank 10 so that when the blank 10 is folded, each envelope is disposed only over two of the four side walls 16. Also, the inflatable cushion may be laminated to the blank 10 over the glue spots 14 The envelope 18 is made of any suitable plastic material, such as polyethylene, and is adhered to the blank 10 by the glue spots 14 in a flattened condition. Typically, the polyethylene envelope 18 that is used is of a thickness of one mil. Further, the envelope 18 may be laminated to the blank 10 in which case, rather than using one or more glue spots 14 to adhere the envelope 18, a layer of the same glue is used to laminate the envelope in place. The layer of glue thus constitutes a glue spot.

Referring to FIG. 2, after the blank 10 has been formed into a carton 15 and an object 19 placed within the carton 15, for example within a bed of loose fill elements 20, the top flaps 13 of the carton 15 are closed over and the carton 15 sealed, for example in a taping machine (not shown).

Thereafter, the closed carton 15 is passed to an inflation station wherein a hollow needle 21 is passed through a cardboard side wall 16, an aligned glue spot 14 and one ply of the plastic envelope 18. During this time, air or other suitable fluid or material is blown through the needle 21 from a suitable source of pressurized air 22 to blow the second ply of the envelope 18 away from the needle 21 to ensure that the needle 21 does not pass through the second ply of the envelope 18. As air continues to flow through the needle 21, the envelope 18 is inflated into a condition, for example as indicated in FIGS. 2 and 3, to secure the object 19 within the carton 15 in a tight-fit secure manner. In this way, the inflated envelope 18 forms an inflated cushion on each of the four walls of the carton 15 while packing the loose fill elements 20 against and around the object 19.

Where the envelope 18 is laminated to a carton wall, the needle 21 may pass through any point in the wall and the glue layer thereon to achieve the result desired, i.e. inflation of the envelope 18.

The needle 21 may have a sharp end to facilitate piercing of the wall 16 or a blunt end with an outlet in a side of the needle 21 to avoid piercing completely through the inflatable envelope 18

After the envelope 18 has been inflated, the needle 21 is withdrawn. At this time, the glue spot 14 closes over on itself to seal the air within the envelope 18.

In order to facilitate passage of the needle 21 through the wall 16 of the cardboard carton 15, the inflation station may position the needle 21 to pass through the carton wall 16 at an angle. For example, the needle 21 is disposed at an angle of 30 degrees to the horizontal and is moved rectilinearly to penetrate through the cardboard wall 16 at that angle.

Further, the needle 21 may be heated during withdrawal in order to facilitate sealing over of the hot melt pressure sensitive glue spot 14. Heating may be made directly of the needle 21 or use may be made of a heated stylet (not shown) which passes through and within the hollow needle 21 to heat the glue spot 14 while the needle 21 is being withdrawn over the stylus and out of the carton wall 16.

The needle 21 may also transfer a small amount of glue from the surface of the needle 21 into the hole made by the needle 21 during piercing of the glue spot(s) when the needle 21 is withdrawn in order to seal the hole. To this end, the needle 21 may be provided with one or more annular grooves to help in pulling glue with the needle 21 during withdrawal to seal the hole.

In another embodiment, the inflation station may have a set of two needles 21 (not shown) that are use to penetrate opposite walls 16 of the carton 15 to inflate the envelope 18 or envelopes therein. Alternatively, the inflation station may have a set of four needles 21 that are used to simultaneously penetrate the four walls 16 of a carton 15 to inflate the envelope(s) therein. Also, the carton 15 may be indexed within the inflation station so that one needle 21 is used to sequentially penetrate two or more walls 16 of the carton 15 to inflate the envelope(s).

It is to be noted that the carton need not employ loose fill elements 20 for the packaging of an object 19. That is to say, the object 19 may be held in place only by the inflated envelope 18 or envelopes that are secured to the side walls 16 of the carton 15.

Further, a plurality of objects (not shown) may be placed in the carton 15. Upon inflation, the envelope 18 fills the carton 15 and pushes the objects towards each other in a compacted state.

Figure 8:
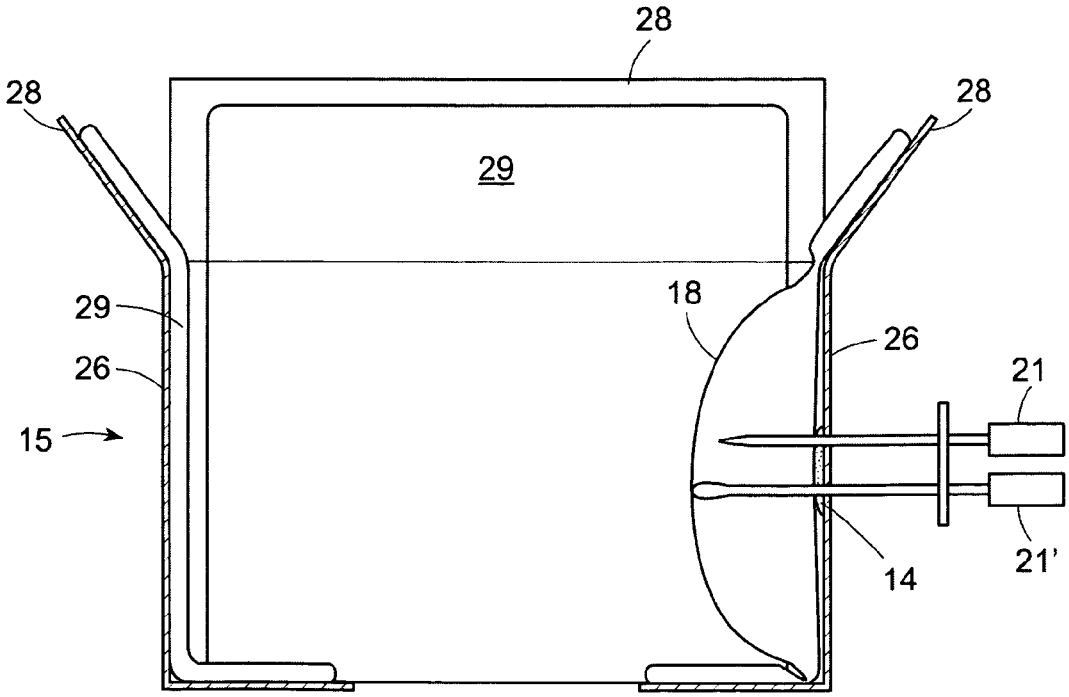
FIG. 8 illustrates a schematic view of an arrangement for inflating an envelope within a carton in accordance with the invention.

Referring to FIG. 8, wherein like reference characters indicate like parts as above, the needle 21 may also be used in tandem with a second hollow needle 21' wherein the one needle 21 delivers an inflating medium into the envelope while the second needle 21' serves to sense the pressure within the inflating envelope 18 and to emit a signal to a controller (not shown) to indicate when the envelope 18 has been inflated to a preset pressure. The sensed pressure is thus used to stop the flow of inflating medium into the envelope 18. As illustrated, the carton 15 need not be closed in order to inflate the envelope. Also, the pressure sensing needle 21' may be positioned other than where the inflating needle 21 is positioned so that the pressure in the envelope 18 is sensed at a point remote from where the inflating medium is introduced. Typically, the pressure of the air or other fluid injected into the envelope 18 can be monitored in the inflation station to sense when the envelope 18 has been inflated to the proper degree.

In another embodiment, use may be made of a second glue spot (not shown) within the envelope 18 that is covered by a protective tape to prevent the glue spot from adhering the two plies of the envelope 18 together. In this embodiment, the second glue spot is aligned with the glue spot that secures the envelope to the carton wall. As above, the needle 21 is used to pierce through both glue spots while air or other fluid or material is injected into the envelope 18 to inflate the envelope 18. Upon withdrawal of the needle 21, the two glue spots ensure that the opening made in the envelope by the needle is sealed over. For example, use may be made of a glue dot that is commercially available from Ultimate Coatings and Adhesive of New Jersey and sold under Production Number MU 1105 and Production Number MU 774-1.

The protective tape may also be a release paper that is used to prevent the two plies of the envelope 18 from sticking together and positioned to act as a flap for additional sealing purposes. For example, the tape would be secured in place at one end to the glue spot so as to pivot relative to the glue spot when the needle 21 passes through the glue spot. Thus, the tape would pivot or partially lift away from the glue spot to allow air into the envelope 18 but would seal over the glue spot when the envelope 18 is filled and under pressure.

The package may also be made in the form of an envelope. For example, a plastic envelope 18 may be laminated, or spot glued, to a blank of heavy paper, such as Kraft paper, that is folded over on itself and sealed along two edges to form an envelope with an open pocket. After stuffing the paper envelope with an object, the plastic envelope within is inflated in an inflation station in a manner as described above with a needle passing through the lamination of glue or a glue spot. Upon inflation, the plastic envelope sandwiches the object in a tight fit secure manner. In this embodiment, the paper envelope may be closed before or after inflation of the plastic envelope.

A closed paper envelope formed of a Kraft paper lined with a plastic layer, such as a bubble wrap layer, may also be secured to a wall of the carton 15 by one or more glue spots 14 or a layer of the glue. Upon passing a needle 21 through the carton wall, glue spot or glue layer, paper layer and plastic layer, the interior of the paper envelope may be inflated.

In other embodiments, the innermost ply of the envelope 18 may be formed with a roughened surface to further secure a packaged item against shifting. Such a roughened surface may be formed, for example, by a ply of bubble wrap.

In those embodiments where the needle 21 is used to introduce a foamable material, such as a foamable polyurethane, from a suitable source into the envelope 18 for inflation purposes, the envelope 18 is provided with pin holes or the like to allow air to escape while the foamable material expands to fill the envelope 18. The same envelope may also be used where polystyrene beads are used to fill and inflate the plastic envelope. Preferably, the envelope 18 is provided with the pin holes on the side facing a carton wall 16 so that any leakage of foam from the envelope would be confined between the wall 16 and the envelope 18. Other suitable vent means than pin holes may also be provided in the envelope 18.

Figure 4:
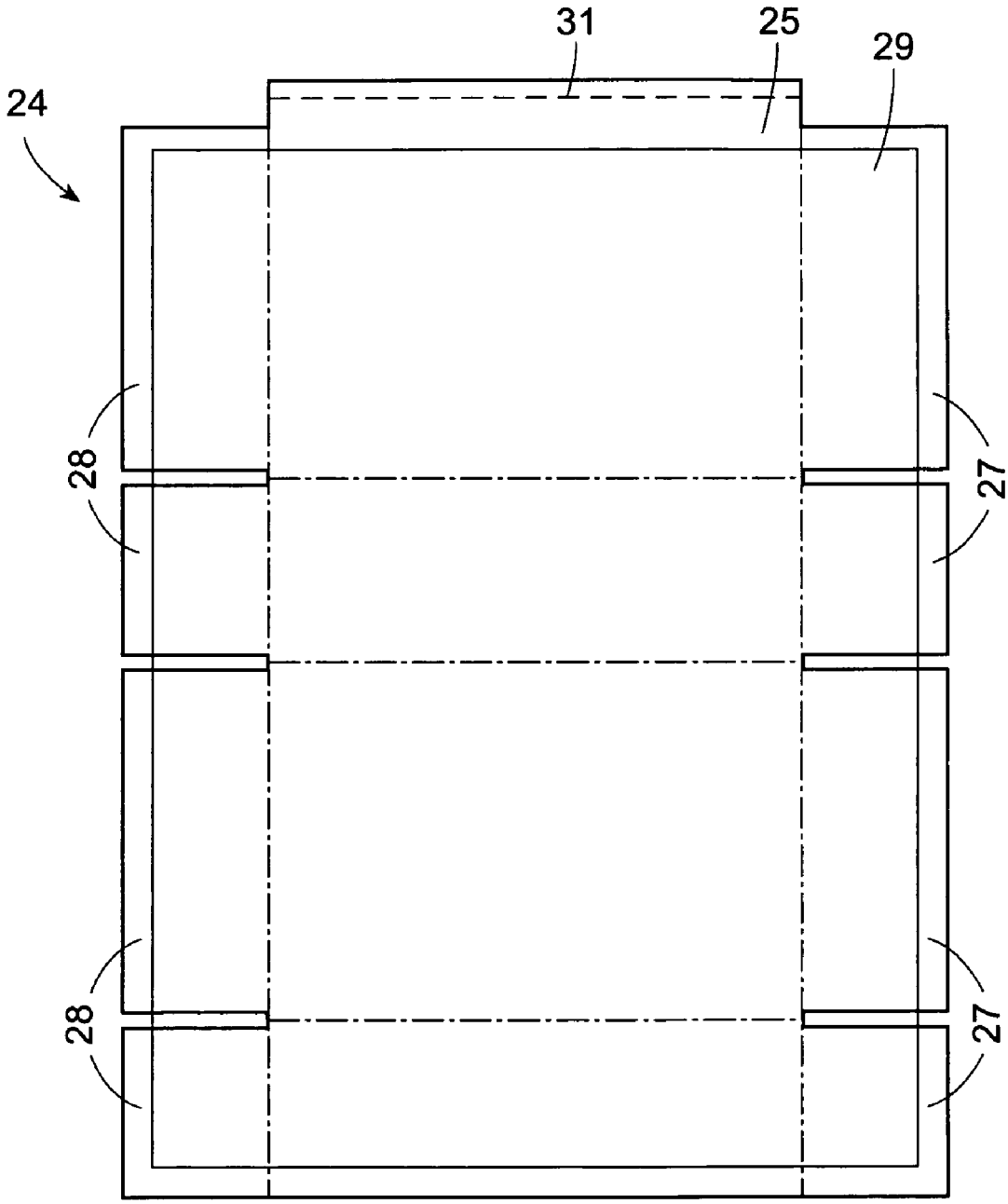
FIG. 4 illustrates a plan view of a blank wherein an inflatable cushion is secured over a central portion of the blank and over a part of the flaps of the blank used for forming a top and bottom of the carton.
Figure 6:
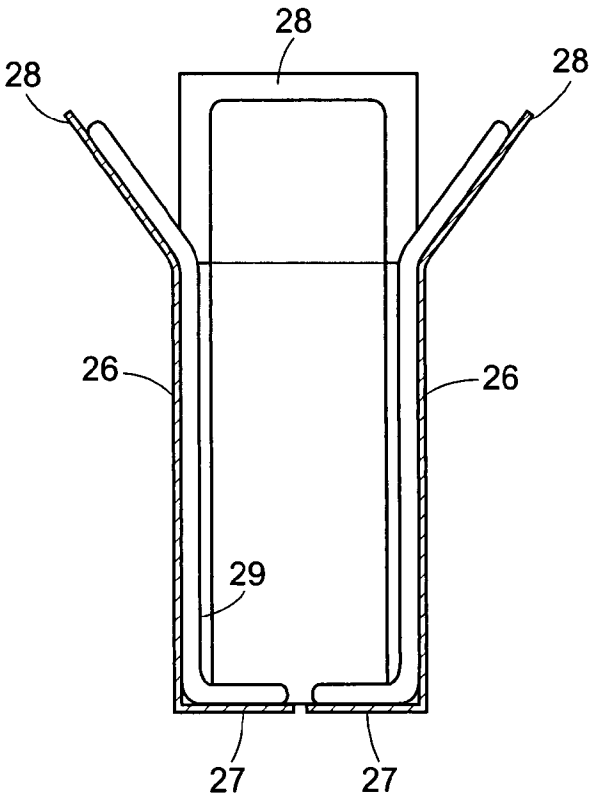
FIG. 6 illustrates a side cross-sectional view of the carton formed from the blank of FIG. 4.
Figure 5:
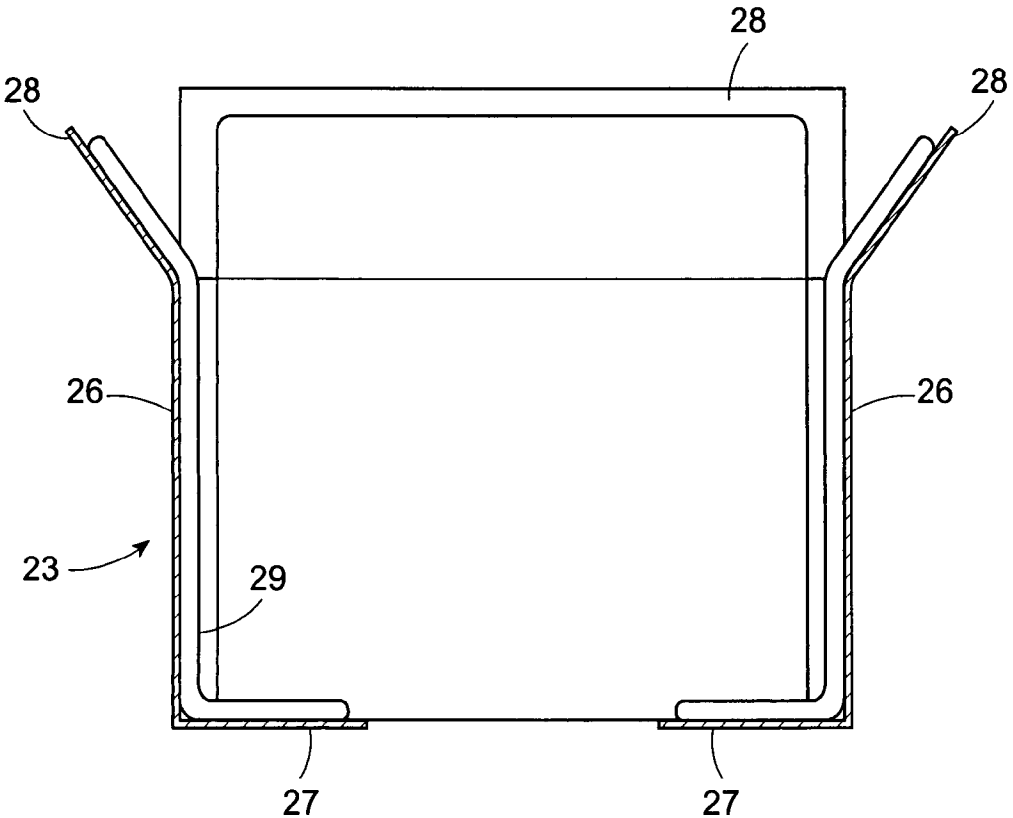
FIG. 5 illustrates a front cross-sectional view of a carton formed from the blank of FIG. 4.

Referring to FIGS. 4, 5 and 6, a package 23 may be made from a cardboard blank 24 that has a central portion 25 for folding over to form four walls 26 of the carton 23, a first plurality of flaps 27 that extend from one side of the central portion 25 for folding into an inter-engageable manner to form a bottom of the carton 23 and a second plurality of flaps 28 extending from the opposite side of the central portion 25 for folding into an inter-engageable manner to form a top (not shown) of the carton. In this embodiment, an inflatable envelope 29 is secured in overlying relation to the central portion 25 and portions of each of the flaps 27, 28.

As illustrated in FIG. 4, the envelope 29 is spaced inwardly of the ends of the flaps 27, 28.

The cardboard blank 24 includes a closure flap 30 that extends from the central portion 25. This closure flap 30 includes spots of adhesive 31. When the central portion 25 is folded, the closure flap is laid over the opposite end of the central portion 25 and adhesively secured thereto with the closure flap 30 within the finished carton 23. Any other suitable means for securing the closure flap 30 to the opposite end of the central portion 25 may also be used.

Upon folding of the cardboard blank 24 into a carton 23, the envelope 29 lines the four vertical walls 26 of the carton 23 as well as substantial portions of the flaps 27 at the bottom of the carton and the flaps 28 at the top of the carton as illustrated in FIGS. 5 and 6.

After one or more items 31 are placed in the carton 23 and the top flaps 28 closed over into inter-engaging manner, the carton 23 is sealed or otherwise closed and forwarded to the inflation station as above.

The envelope 29 is secured to the central portion 25 in a manner as described above with respect to the embodiment of FIG. 1. That is, the envelope 29 is secured to each section of the central portion 25 that is to form a vertical wall 26 of the carton 23 by a blue spot (not shown). However, the envelope 29 is not secured to the flaps 27, 28.

Figure 7:
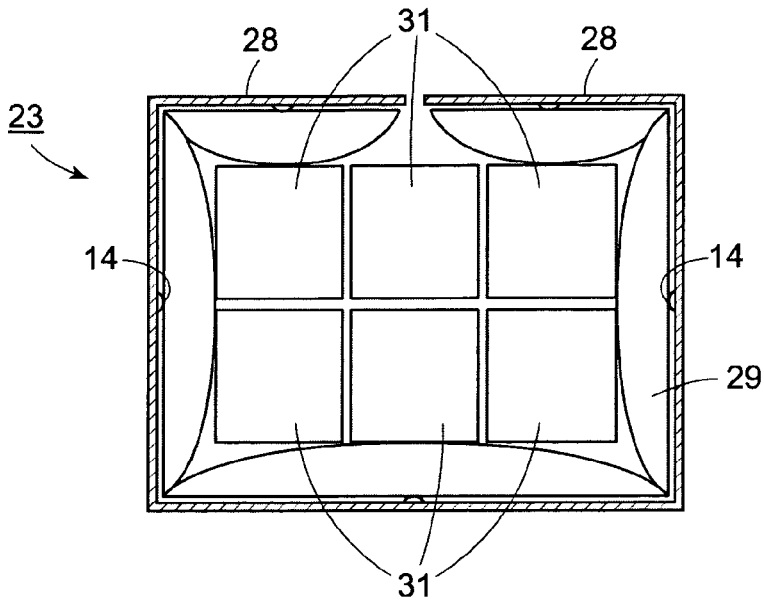
FIG. 7 illustrates a schematic cross-sectional view of the carton of FIGS. 5 and 6 with the cushion in an inflated condition about items within the carton.

In order to inflate the envelope 29 a needle, as above, is penetrated through at least one wall 26 of the carton 23, the glue spot (not shown) and the first ply of the envelope 29. Upon inflation, the envelope 29 expands to form an inflated cushion about the items 31 as schematically illustrated in FIG. 7.

During inflation of the envelope 29, air flows through the entire envelope 29 to inflate not only along the four vertical walls 26 but also along the flaps 27 forming the bottom of the carton and the flaps 28 forming the top of the carton. Thus, the items 31 within the carton 23 are not only cushioned along the four sidewalls, but also along the bottom and the top of the carton 23.

The inflatable cushion 18 is described as having two-plies and by that is meant to mean that the inflatable cushion is any inflatable device that, when collapsed, has two sides that define a space therebetween, such as a collapsed rubber balloon, and that can be inflated to move the two sides apart. Also, the The inflatable cushion may also be constructed with one or more intermediate portions that, upon inflation, become disposed in an upright condition within a package to serve as dividers within the package and being located between items within the package. Typically, these intermediate portions can be formed by folded over portions of the inflatable cushion that is secured to the flaps 27 that form the bottom of the carton. When the cushion is inflated, these intermediate portions inflate and move away from laying flat against the part of the cushion that is secured to the flaps 27 to upright vertical positions. When items are placed in the carton prior to sealing of the carton, the intermediate portions unfolded into positions between the various items so that upon inflation, the intermediate portions, i.e. dividers, are already in place.

The carton may be constructed in any suitable shape, such as cylindrical, cubic or otherwise. The inflatable cushion may be formed of any suitable material such as those described above as well as a balloon-like structure.

The number of inflatable cushions used within a carton may be varied. For example, use may be made of only one inflatable cushion on one wall or part of a wall of a carton, or only on the bottom or only on the top of the carton.

The invention thus provides a carton that has an integrated inflatable cushion within that can be inflated from without using a simple hollow needle and means for injecting a fluid through the needle into the cushion. The invention allows for complete packaging around the interior perimeter of the carton and groups all objects to the center for better protection.

Further, the invention provides a package that may be made from a cardboard blank that is previously provided with an inflatable cushion that can be secured in place on an in-line assembly basis.

Further, the invention provides an insulated carton that can be readily disposed of by an ultimate consumer without concern for loose air bags or the like.

Still further, the invention provides a carton with an inflatable cushion that can be inflated from outside the carton and that will not leak during transit. Also, the carton can be assembled with the inflatable envelope in a relatively inexpensive manner since there is no need for a valve or a hole in the carton to accommodate a valve.

What is claimed is:

1. An assembly comprising a package including at least one wall defining a compartment for receiving goods and an inflatable envelope having two plies defining an enclosed space and disposed on said wall;

a hollow needle for penetrating said wall and passing into said envelope; and means for blowing a stream of fluid through said needle into said envelope for inflation of said envelope.

2. An assembly as set forth in claim 1 wherein said envelope has two piles defining an enclosed space, and which further comprises a first glue spot disposed on one of said plies and facing the other of said two plies; a protective tape disposed over said glue spot to prevent said glue spot from adhering to said other ply of said envelope; and a second glue spot aligned with said first glue spot and securing said envelope to said wall and wherein said needle is disposed to pass through each said glue spot.

3. An assembly as set forth in claim 2 further comprising a stylus reciprocally mounted within said needle for heating each said glue spot.

4. An assembly as set forth in claim 1 wherein said needle is heated.

5. An assembly as set forth in claim 1 wherein said needle has a blunt end.

6. An assembly as set forth in claim 1 wherein said means blows a stream of foamable material into said envelope.

7. An assembly as set forth in claim 6 wherein said envelope has a plurality of holes therein for the escape of air from said envelope during filling with foamable material.

8. An assembly as set forth in claim 7 wherein said holes are in facing relation to said wall.

9. An assembly as set forth in claim 1 further comprising a plurality of said walls defining a cubic shape having four vertical walls and a bottom wall, each said wall being a cardboard layer and wherein said envelope is disposed on at least one of said walls and said bottom.

10. An assembly as set forth in claim 9 further comprising a plurality of glue spots, each said glue spot being disposed on and between said envelope and a respective one of said vertical walls to secure said envelope to said respective wall.

11. An assembly as set forth in claim 9 further comprising a taping machine for closing said package.

* * * * *